US006970665B2

(12) United States Patent
Kuma et al.

(10) Patent No.: US 6,970,665 B2
(45) Date of Patent: Nov. 29, 2005

(54) IMAGE FORMING APPARATUS WITH DETACHABLE POWER-REQUIRING UNIT

(75) Inventors: Kazuosa Kuma, Kanagawa (JP); Hiroshi Ishii, Kanagawa (JP); Yuusuke Noguchi, Tokyo (JP); Makoto Kikura, Kanagawa (JP); Yutaka Fukuchi, Kanagawa (JP); Kazuki Suzuki, Saitama (JP)

(73) Assignee: Ricoh Company, Limited, Tokyo (JP)

( * ) Notice: Subject to any disclaimer, the term of this patent is extended or adjusted under 35 U.S.C. 154(b) by 180 days.

(21) Appl. No.: 10/695,794

(22) Filed: Oct. 30, 2003

(65) Prior Publication Data

US 2004/0131380 A1 Jul. 8, 2004

(30) Foreign Application Priority Data

Oct. 30, 2002 (JP) ..... 2002-316709

(51) Int. Cl.[7] ..... G03G 15/00
(52) U.S. Cl. ..... 399/90; 439/911
(58) Field of Search ..... 399/88–90; 439/911, 439/144, 225, 509

(56) References Cited

U.S. PATENT DOCUMENTS

| | | | | |
|---|---|---|---|---|
| 5,040,025 | A | 8/1991 | Fukuchi | |
| 5,052,336 | A | 10/1991 | Fukuchi | |
| 5,055,881 | A | 10/1991 | Fukuchi | |
| 5,124,759 | A | 6/1992 | Fukuchi et al. | |
| 5,300,996 | A | 4/1994 | Yokoyama et al. | |
| 5,329,340 | A | 7/1994 | Fukuchi et al. | |
| 5,628,055 | A * | 5/1997 | Stein | |
| 5,689,764 | A | 11/1997 | Fukuchi et al. | |
| RE36,124 | E | 3/1999 | Yokoyama et al. | |
| 5,913,095 | A | 6/1999 | Takashima et al. | |
| 6,128,451 | A | 10/2000 | Fukuchi | |
| 6,181,899 | B1 | 1/2001 | Fukuchi | |
| 6,385,418 | B1 | 5/2002 | Fukuchi | |
| 6,576,177 | B2 | 6/2003 | Fukuchi | |
| 6,607,391 | B2 * | 8/2003 | Mendelson et al. | |
| 6,647,223 | B2 | 11/2003 | Ishii | |
| 6,674,982 | B2 | 1/2004 | Saitoh et al. | |
| 6,757,515 | B2 | 6/2004 | Ueda | |
| 6,832,061 | B2 | 12/2004 | Saito et al. | |
| 6,834,850 | B2 | 12/2004 | Fukuchi | |
| 2004/0009004 | A1 * | 1/2004 | Mizoguchi | 399/90 |

FOREIGN PATENT DOCUMENTS

| | | |
|---|---|---|
| JP | 7-43973 | 2/1995 |
| JP | 2002-189320 | 7/2002 |
| JP | 2002-258561 | 9/2002 |

OTHER PUBLICATIONS

U.S. Appl. No. 10/101,994, filed Mar. 21, 2002, Ueda.
U.S. Appl. No. 10/279,904, filed Oct. 25, 2002, Fukuchi.
U.S. Appl. No. 10/293,334, filed Nov. 14, 2002, Saito et al.

(Continued)

*Primary Examiner*—Susan Lee
(74) *Attorney, Agent, or Firm*—Oblon, Spivak, McClelland, Maier & Neustadt, P.C.

(57) ABSTRACT

An electrode of an image bearing unit and an electrode of a power supply are positioned in the front, rather than far inside of the main body of the image forming apparatus. A holder opposes these electrodes in an openable/closable manner. The holder includes an electric conductor that electrically connects the electrode of an image bearing unit and an electrode of a power supply when the holder is closed. The image bearing unit can be detached or attached when the holder is open.

17 Claims, 6 Drawing Sheets

OTHER PUBLICATIONS

U.S. Appl. No. 10/417,169, filed Apr. 17, 2003, Fukuchi.
U.S. Appl. No. 10/430,208, filed May 7, 2003, Fukuchi.
U.S. Appl. No. 10/441,105, filed May 20, 1993, Kasahara et al.
U.S. Appl. No. 10/812,953, filed Mar. 31, 2004, Takahashi et al.
U.S. Appl. No. 10/812,971, filed Mar. 31, 2004, Takahashi et al.
U.S. Appl. No. 10/933,213, filed Sep. 3, 2004, Watanabe et al.
U.S. Appl. No. 10/942,879, filed Sep. 17, 2004, Muramatsu et al.

* cited by examiner

IMAGE FORMING APPARATUS WITH DETACHABLE POWER-REQUIRING UNIT

BACKGROUND OF THE INVENTION

1) Field of the Invention

The present invention relates to an image forming apparatus with a power-requiring unit that is detachable and requires power supply.

2) Description of the Related Art

Electronic copying machines, printers, facsimiles, and multifunction peripherals are the examples of image forming apparatuses. Such image forming apparatuses include a power-requiring unit and a power source, which supplies power to the power-requiring unit. The power-requiring unit is, for example, an electric charger, which charges an image bearing member. The power-requiring unit is attached inside a main body of the image forming apparatus in a detachable manner.

The power source is placed at the far inside of the main body along the direction of insertion or detachment (hereinafter, "insertion-detachment direction") of the power-requiring unit. When the power-requiring unit is set inside the image forming apparatus at its appropriate position, a connector of the power-requiring unit makes an electric contact with a connector of the power source and an electric connection between the two is established.

The connectors of the power-requiring unit and the power source may be placed in the front, instead of far inside, along the insertion-detachment direction. However, in that case, a harness becomes necessary to establish an electric connect between the connectors of the power-requiring unit and the power source. However, when the harness is provided, when detaching the power-requiring unit, it is necessary to dismantle the harness first, attach the power-requiring unit, and then attach the harness again. Thus, the detachment of the power-requiring unit becomes cumbersome.

SUMMARY OF THE INVENTION

It is an object of the present invention to solve at least the above in the conventional technology.

An image forming apparatus includes a main body having an opening; a power-requiring unit that can be attached to the main body by being inserted in an insertion direction via the opening, and that can be detached from the main body by being pulled out in a detachment direction via the opening, the power-requiring unit having a front side toward the insertion direction and an electrode arranged on the front side; and a power source that supplies power to the power-requiring unit, the power source having a front side and an electrode arranged on the front side; an arrangement that detachably fits almost into the opening and that includes an electric conductor, wherein the electric conductor makes electric contact with the electrodes of the power-requiring unit and the power source when the arrangement is fit, and the power-requiring unit can be attached or detached via the opening when arrangement is detached.

These and other objects, features and advantages of the present invention are specifically set forth in or will become apparent from the following detailed descriptions of the invention when read in conjunction with the accompanying drawings.

DETAILED DESCRIPTION

Exemplary embodiments of the present invention are explained next with reference to the accompanying drawings.

Figure 1:
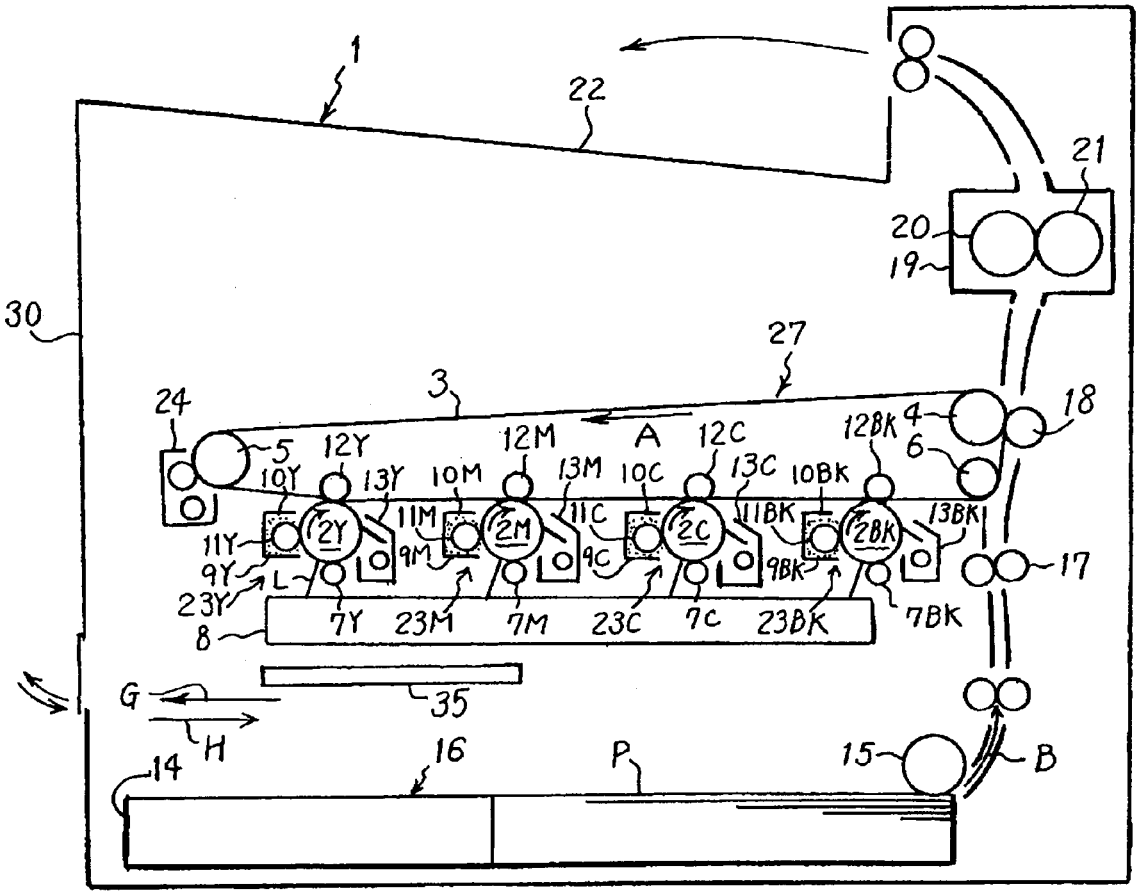
FIG. 1 is a cross-section of an image forming apparatus according to an embodiment of the present invention.

FIG. 1 is a vertical cross-section of an image forming apparatus according to an embodiment of the present invention. This image forming apparatus includes a main body 1 that houses first to fourth image bearing members 2Y, 2M, 2C, and 2BK, and an intermediate transfer body 3. The image bearing members are drum-shaped and are photosensitive elements. The transfer body 3 is an endless belt and holds a toner image. The toner image is transferred to a recording medium. The intermediate transfer body 3 is suspended by supporting rollers 4, 5, and 6. These supporting rollers 4, 5, and 6 rotatably drive the intermediate transfer body 3 in the direction of the arrow A.

A toner image is formed on each of the first to fourth image bearing members 2Y, 2M, 2C, and 2BK and all those toner images are transferred to the intermediate transfer body 3. The structure of all the image bearing members 2Y, 2M, 2C, and 2BK is same, except that they form toner images of different colors. Hence, the structure and the operation of the first image bearing member 2Y, which forms a yellow image, will be explained.

The image bearing member 2Y is rotated in the clockwise direction. While the image bearing member 2Y rotates, a charging device, which is a charging roller 7Y, charges it to a predetermined polarity. An optical unit 8 emits an optically modulated laser beam L onto the image bearing member 2Y to form an electrostatic latent image on the image bearing member 2Y. A developing device 9Y develops the electrostatic latent image with a yellow toner. The developing device 9Y includes a container 10Y that contains dry developer and a roller 11Y. The roller 11Y is rotatably held it and carries the developer to the image bearing member 2Y. A developing bias-potential is applied to the roller 11Y when developing the electrostatic latent image on the image bearing member 2Y.

A transferring device, which is a transfer roller 12Y, is placed opposite to the image bearing member 2Y with the intermediate transfer body 3 sandwiched between the two. A transfer voltage is applied to the transfer roller 12Y so that the yellow image is transferred on to the intermediate transfer body 3. A cleaning device 13Y removes, or cleans, the yellow toner remaining on the image bearing member 2Y after the yellow image has been transferred.

A magenta image, a cyan image, and a black image, are formed on the second to fourth image bearing members 2M, 2C, and 2BK, respectively, in the same manner. The magenta, cyan, and black images are sequentially transferred on to the yellow image on the intermediate transfer body 3 to thereby form a full-color image. Suffices M, C, and BK are attached to components in the second to fourth image bearing members 2M, 2C, and 2BK.

A cassette 14 that houses a recording medium P, and a paper feed device 16 that includes a paper feed roller 15 are provided at the bottom of the main body 1. The paper feed roller 15 forwards the recording medium P in the direction of the arrow B. Rollers 17 feed the recording medium P between the supporting roller 4 and a roller 18 at a predetermined timing. A predetermined voltage is then applied to the supporting roller 4 and accordingly the full-color image on the intermediate transfer body 3 is transferred on to the recording medium P.

The recorded medium P with the full-color image is then passed through a fixing device 19 where the full-color image is fixed on the recording medium P. The fixing device 19 includes a fixing roller 20 and a pressure roller 21. The recorded medium P is sandwiched between the fixing roller 20 and the pressure roller 21. The fixing roller 20 is hot, and the heat causes the full-color image on the recorded medium P to be fixed on the recording medium P. The recording medium P with the image printed on it is then ejected to the outside of the main body 1. A cleaning device 24 removes, or cleans, the toner remaining on the intermediate transfer body 3.

The image bearing member 2Y, the charging roller 7Y, the developing device 9Y, and the cleaning device 13Y constitute a first image bearing unit 23Y. The second to fourth image bearing units 23M, 23C, and 23BK have similar structure.

Figure 2:
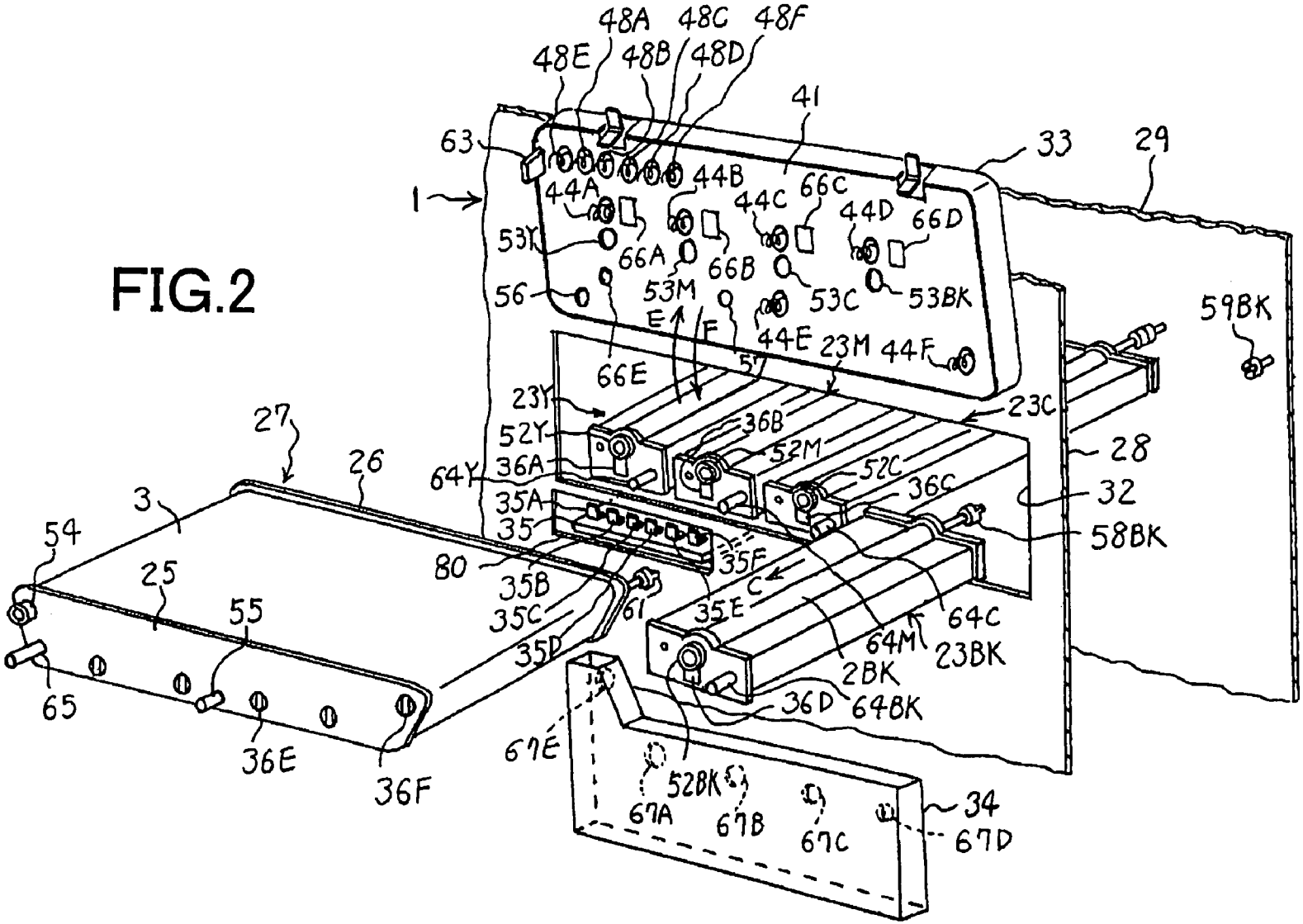
FIG. 2 is a perspective view when a holder is opened.

All the image bearing units 23Y, 23M, 23C, and 23BK are fixed in the main body 1 in a detachable manner along a direction that is normal to the paper on which FIG. 1 is printed. FIG. 2 is a perspective view of the image bearing units 23Y, 23M, 23C, and 23BK. FIG. 2 illustrates a case when the image bearing units 23Y, 23M, and 23C are fixed inside the main body 1 and the image bearing unit 23BK is being detached by being pulled toward the direction represented by the arrow C.

Frames 25 and 26 (see FIG. 2) hold together the intermediate transfer body 3, the supporting rollers 4, 5, and 6, the transfer rollers 12Y, 12M, 12C, and 12BK, the cleaning device 24 to thereby form an intermediate transfer unit 27. Although FIG. 2 illustrates that the intermediate transfer unit 27 is outside of the main body 1, it is fixed inside the main body 1 in a detachable manner by inserting it inside the main body 1 in the direction opposite to that of the arrow C.

Figure 3:
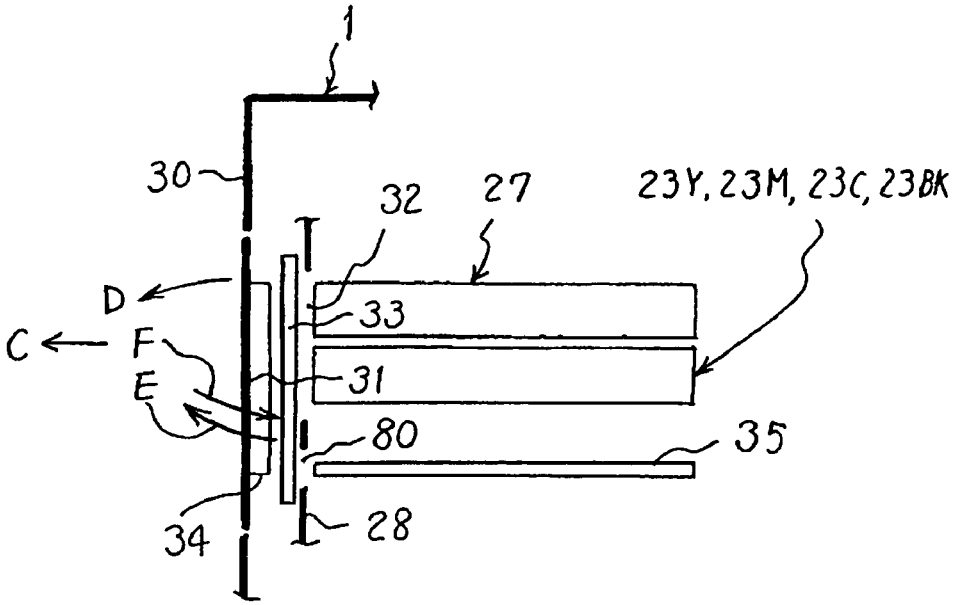
FIG. 3 illustrates the positional relation between an image bearing unit, an intermediate transfer body, a power source, the holder, and a door.

The main body 1 includes a front board 28, a rear board 29, and an outer cover 30 (FIG. 1). FIG. 3 illustrates the positional relation between the main body 1, the image bearing units 23Y, 23M, 23C, and 23BK, and the intermediate transfer unit 27. The outer cover 30 has a door 31. When the door 31 is opened by pulling along the direction of the arrow D, the image bearing units 23Y, 23M, 23C, and 23BK and the intermediate transfer unit 27 are accessible for attachment/detachment via an opening 32 (see FIG. 2) in the front board 28. A residual toner container for collecting once used toner is supported by the door 31. The residual toner collected by cleaning devices 13Y, 13M, 13C, and 13BK and the cleaning device 24 transported into the residual toner container 34. After opening the holder 33 by pulling it along the direction of the arrow E, the image bearing units 23Y, 23M, 23C, and 23BK can be accessed for attachment/detachment.

Power-requiring units are provided inside the main body 1 in a detachable manner. The charging rollers 7Y, 7M, 7C, and 7BK, the transfer rollers 12Y, 12M, 12C, and 12BK, rollers 11Y, 11M, 11C, and 11BK, and the supporting roller 4, etc, constitute the power-requiring units.

Figure 4:
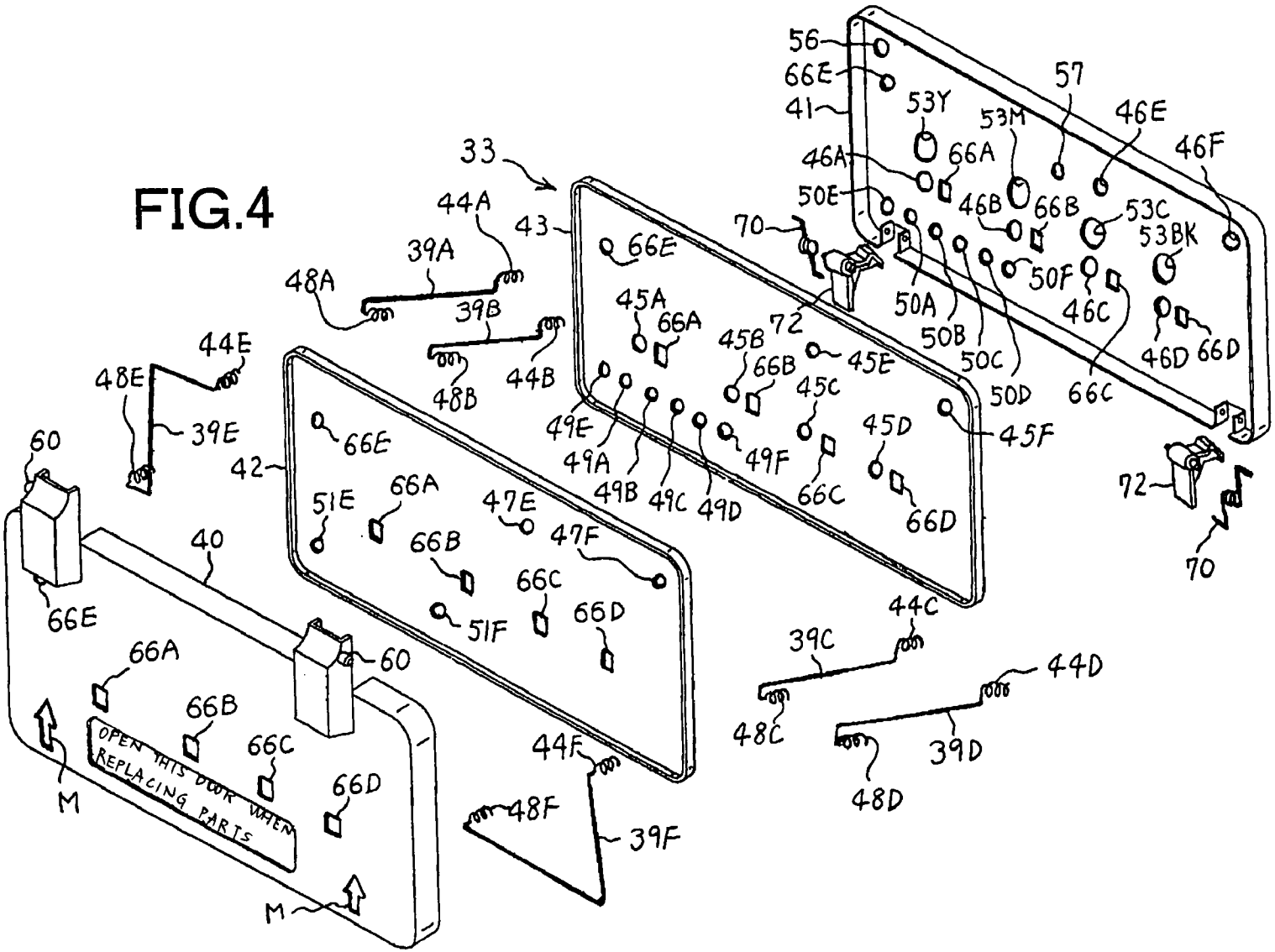
FIG. 4 is an exploded perspective of the holder.

A power source 35 supplies power to all of or desired one of the power-requiring units. The power source 35 is, for example, a high-voltage supplying board. In order to avoid complications in the drawing, it is assumed here that the power source 35 supplies power to only the transfer roller 12C and the supporting roller 4. The power source 35 has electrodes 35A, 35B, 35C, 35D, 35E, and 35F (see FIG. 2). The charging rollers 7Y, 7M, 7C, and 7BK have electrodes 36A, 36B, 36C, and 36D, respectively. The transfer roller 12C has an electrode 36E, and the supporting roller 4 has an electrode 36F. Thus, all these electrodes are placed in the front, and not far inside, of the main body 1. The holder 33 electrically connects the electrodes of the power source 35 to those of the charging rollers, the transfer rollers, and the supporting roller. As shown in FIG. 4, the holder 33 holds first to sixth conductors, namely, 39A, 39B, 39C, 39D, 39E, and 39F. The electrodes 36A to 36F are electrically connected to the electrodes 35A to 35D, respectively, via each conductor 39A to 39F. These conductors are, for example, metallic wires. An opening 80 (see FIG. 2, 3) is provided in a portion of the front board 28 opposite to the electrodes 35A to 35D of the power source 35.

The holder 33 is supported by the front board 28 such that the holder 33 can turn and open-close along the direction of the arrows E and F (see FIG. 2, 3). FIG. 3 illustrates a case when the holder 33 is fixed in its appropriate position, while FIG. 2 illustrates a case when the holder 33 is detached, or opened. The holder 33 and the main body 1 have a mechanism so that the holder 33 can be fit or detached to the main body easily.

FIG. 4 is an exploded perspective of the holder 33. The holder 33 includes plural insulation plates. For example, as illustrated in FIG. 4, the holder 33 includes a front plate 40, a rear plate 41, a first intermediate plate 42, and a second intermediate plate 43. These plates are fixed to each other with screws (not shown). The conductors 39A to 39F are sandwiched between two successive insulation plates. The first to fourth conductors 39A to 39D are sandwiched between the first intermediate plate 42 and the second intermediate plate 43, while the fifth and sixth conductors 39E and 39F are sandwiched between the front plate 40 and the first intermediate plate 42. A hinge pin 60 supports free turn and open-close movement of the holder 33 in the main body 1.

The conductors 39A to 39D have ends 44A to 44D on one side thereof. These ends 44A to 44D pass through holes 45A to 45D, respectively, provided in the second intermediate plate 43 and holes 46A to 46D, respectively, provided in the rear plate 41, and then appear outside the holder 33 (see FIG. 2). When the holder 33 is at fixed, the ends 44A to 44D respectively make contact with the electrodes 36A to 36D.

The fifth and sixth conductors 39E and 39 have ends 44E and 44F, respectively. These ends 44E and 44F pass through holes 47E and 47F, respectively, provided in the first intermediate plate 42, holes 45E and 45F, respectively, provided in the second intermediate plate 43, and holes 46E and 46F, respectively, provided in the rear plate 41, and then appear outside the holder 33 (see FIG. 2). When the holder 33 is fixed, the end 44E makes contact with the electrode 36E of the transfer roller 12C and the end 44F makes contact with the electrode 36F of the supporting roller 4. The electrodes 36A to 36D may be fabricated, for instance, from plate blades that make contact with the rollers 7Y, 7M, 7C, and 7BK, 12C, and 4, or plate blades that make contact with bearings which support free turning movement of these rollers, etc. It is also possible to convert a portion of the rollers 7Y, 7M, 7C, and 7BK, 12C, and 4 into power-requiring units by applying a direct contact between the ends of the conductors 39A to 39F and the rollers 7Y, 7M, 7C, and 7BK, 12C, and 4.

The first to fourth conductors 39A to 39D have ends 48A to 48D, respectively. These ends 48A to 48D pass through holes 49A to 49D, respectively, provided in the second intermediate plate 43 and holes 50A to 50D, respectively, provided in the rear plate 41. The fifth and sixth conductors 39E and 39F have ends 48E and 48F, respectively. These ends 48E and 48F pass through holes 51E and 51F, respectively, provided in the first intermediate plate 42, holes 49E and 49F, respectively, provided in the second intermediate plate 43, and holes 50E and 50F, respectively, provided in the rear plate 41. The ends 48A to.48F then appear outside the holder 33 (see FIG. 2). When the holder 33 is fixed, the ends 48A to 48F make contact with the electrodes 35A to 35F, respectively, of the power source 35 (see FIG. 5). In this way, when the holder 33 is fixed, the ends 44A to 44F of the conductors 39A to 39F make contact with the electrodes 36A to 36D, respectively, of the power-requiring units, while the ends 44A to 44F of the conductors 39A to 39F make contact with the electrodes 35A to 35F, respectively, of the power source 35. Thus, it is possible to apply a respective predetermined voltage to the charging rollers, the transfer rollers, and the supporting rollers.

When detaching the image bearing units 23Y, 23M, 23C, and 23BK and the intermediate transfer unit 27 from the main body 1, the door 31 is opened, the holder 33 is opened, and the image bearing units 23Y, 23M, 23C, and 23BK and the intermediate transfer unit 27 are detached. When the holder 33 is opened, the ends 44A to 44F and 48A to 48F of the conductors 39A to 39F part away from the respective electrodes.

As described above, although a harness is not provided, the electrodes of the power source and the electrodes of the power-requiring units are located in the front along the insertion-detachment direction. As a result, insertion or detachment of parts can be performed easily.

Although, in the holder 33, the conductors 39A to 39F are located close to each other, as the holder 33 is made of insulation plates, short-circuit between the conductors can be prevented. Because the conductors are located close to each other, it is possible to miniaturize the holder 33.

The image forming apparatus according to the present embodiment comprises the image bearing members 2Y, 2M, 2C, and 2BK in which the toner images are formed, and these image bearing members 2Y, 2M, 2C, and 2BK are the components of the respective image bearing units 23Y, 23M, 23C, and 23BK. By attaching the image bearing units to the main body 1 or removing the image bearing units from the main body 1, the image bearing members can be attached or removed. In this way, the image bearing members are attached in the main body 1 in a detachable manner. By opening the holder 33, the image bearing members can be attached to or removed from the main body 1. As shown in FIG. 2, in the rear plate 41 of the holder 33, index holes 53Y, 53M, 53C, and 53K are provided where bearings 52Y, 52M, 52C, and 52K, which are placed in the front along the direction in which the image bearing members 2Y, 2M, 2C, and 2BK are detached, undergo interdigitation. When the holder 33 is fixed, the bearings 52Y, 52M, 52C, and 52K of the image bearing members 2Y, 2M, 2C, and 2BK undergo interdigitation with the index holes 53Y, 53M, 53C, and 53K, respectively, and each image bearing member is set to a predetermined position. In this way, by keeping the holder 33 at the closing position, the position of the image bearing members attached in the main body 1 can be set.

The image forming apparatus according to the present embodiment includes the intermediate transfer unit 27 that comprises the intermediate transfer body 3 on which the toner images formed on the image bearing members are transferred. The intermediate transfer unit 27 is attached in the main body 1 in a detachable manner. By keeping the holder 33 at the opening position as shown in FIG. 2, the intermediate transfer unit 27 can be attached to or removed from the main body 1. In the rear plate 41 of the holder 33, index holes 56 and 57 are provided. When the holder 33 is fixed, a bearing 54 (see FIG. 2) of the supporting roller 5, which is a component of the intermediate transfer unit 27, and an index pin 55, which is provided as a protrusion in the frame 25 that is a component of the intermediate transfer unit 27, undergo interdigitation with index holes 56 and 57, respectively, and the position of the intermediate transfer unit 27 is set. In this way, by keeping the holder 33 at the closing position, the position of the intermediate transfer unit 27 attached inside the main body 1 can be set.

As the position of the image bearing members and the intermediate transfer unit can be set by means of the holder 33, there is no need to provide another component exclusively to set the position. Hence, the structure of the image forming apparatus can be simplified.

The ends 44A to 44F of the conductors 39A to 39F and making contact with the electrodes 36A to 36D of the power-requiring units, and the ends 48A to 48F of the conductors 39A to 39F and making contact with the electrodes 35A to 35F of the power source 35 are fabricated from a compression coil spring. The structure is such that when the holder 33 is fixed, according to the elasticity, the ends 44A to 44F of the conductors 39A to 39F are pressed upon and pressure-welded to the electrodes 36A to 36D of the electrodes, while the ends 48A to 48F of the conductors 39A to 39F are pressed against the electrodes 35A to 35F of the power source 35. Consequently, the ends of the conductors make firm contact with the power-requiring units and the ends of the conductors make definite contact with the electrodes, and the defect due to bad contact can be prevented.

The image bearing units 23Y, 23M, 23C, and 23BK include the image bearing members 2Y, 2M, 2C, and 2BK, respectively, and the power-requiring units. As shown in FIG. 2, a coupling component 58BK is fixed at the back along the direction in which the image bearing member 2BK is detached. A partner coupling component 59BK is rotatably supported by the rear board 29 of the main body 1 and is rotate-driven by means of a not shown driving motor supported by the rear board 29. When the image bearing member 23BK is set inside the main body 1, the coupling component 58BK and the partner coupling component 29BK get coupled, the rotation movement of the driving motor is transmitted to the image bearing member 2BK via the coupling component 58BK and the partner coupling component 29BK, and the image bearing member 2BK is rotate-driven. At the same time, this rotation movement is transmitted to the charging roller 7BK or the roller 11BK via a transmission component, etc., and the charging roller 7BK and the roller 11BK are rotate-driven.

As the end 44D on one side of the fourth conductor 39D and making contact with the power-requiring unit 36D is fabricated from a compression coil spring, the end 44D increases the pressure on the coupling component 58BK on the image bearing unit 23BK with respect to the partner coupling component 59BK of a driving device, which drives the image bearing unit 23BK. Consequently, both the coupling components 58BK and 59BK get coupled and the image bearing member 2BK and the roller 11BK rotate stably, and a high quality image can be formed in the image bearing member 2BK. An identical structure is applied to the image bearing units 23Y to 23C that include the image bearing members 2Y to 2C, respectively.

Similarly, a coupling component 61 is fixed in the supporting roller 4 of the intermediate transfer unit 27 shown in FIG. 1. When the intermediate transfer unit 27 is attached in the main body 1, the coupling component gets coupled with a partner coupling component of a not shown driving device, and the supporting roller 4 is rotate-driven via these coupling components. In this case also, the end 44F on one side of the conductor 39F and fabricated from a compression coil spring increases the pressure on the coupling component 61 on the intermediate transfer unit 27 with respect to the partner coupling component on the driving device, which drives the intermediate transfer unit 27. Consequently, both the coupling components get coupled and the intermediate transfer body 3 can rotate evenly.

Figure 5:
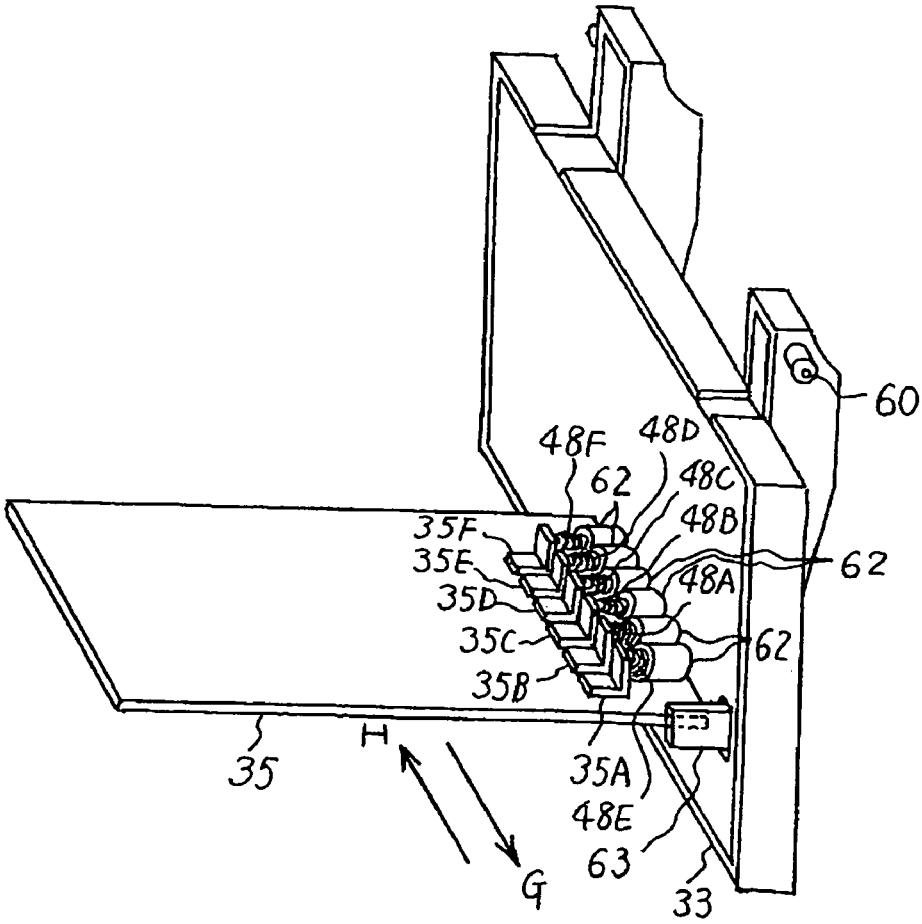
FIG. 5 is a perspective view of the positional relation between the holder at the closing position and a power source.

As shown in FIG. 5, when the ends 44A to 44F and 48A to 48F of the conductors are fabricated from a compression coil spring, it is desirable to provide a cylindrical unit (not shown) integrated along with the holder 33. It is also better to provide the cylindrical unit 62 in the first intermediate plate 42 and the second intermediate plate 43 and concentric to the holes 51E, 51F, 47E, 47F, 49A to 49F, and 45A to 45F.

FIG. 5 is a view of the relative positional relation between the power source 35 and the holder 33 when the holder 33 is fixed. As shown in FIG. 5 and FIG. 1, the power source 35 is attached in the main body 1 along the direction of arrows G and H, and can be removed from the main body 1. The structure is such that the power source 35 may be replaced with another component. When the holder 33 is fixed and. consequently the ends 48A to 48F of the conductors 39A to 39F make contact with the electrodes 35A to 35F of the power source 35, if the power source 35 is detached along the direction of arrow G, a large frictional force is generated between the ends 48A to 48F and the electrodes 35A to 35F that may cause dents on the ends 48A to 48F and the electrodes 35A to 35F.

A stopper 63 is provided as a protrusion in the holder 33. Hence, when the holder 33 is fixed, the power source 35 collides with the stopper 63 and thus cannot be detached along with the direction of arrow G. When the holder 33 is opened, the stopper 63 is removed from the power source 35 and then the power source can also be attached or removed. The stopper 63 illustrates an example of a power source removal-prohibiting unit that, when the holder 33 is fixed, prohibits the removal of the power source from the main body.

As shown in FIG. 2 and FIG. 3, the residual toner container 34 is provided at a position in front than the holder 33 at the closing position and along the direction in which the power-requiring units are detached. The residual toner container 34 according to the present embodiment is supported at the inner surface of the door 31 and can be attached to or removed from the door 31. Toner drain pipes 64Y, 64M, 64C, and 64BK and 65 are connected to the cleaning devices 13Y, 13M, 13C, and 13BK and 24, respectively, shown in FIG. 1. When the door 31 and the holder 33 are closed, the toner drain pipes 64Y, 64M, 64C, and 64BK and 65 pass through holes 66A to 66E, respectively, provided in the holder 33, and enter into toner inlet holes 67A to 67E, respectively, provided in the residual toner container 34. The residual toner after transfer collected in the cleaning apparatuses 13Y, 13M, 13C, and 13BK and 24 is sent to the residual toner container 34 via the respective toner drain pipes 64Y, 64M, 64C, and 64BK and 65 and collected in the residual toner container 34. When the door 31 and the holder 33 are opened, the toner inlet holes 67A to 67E of the residual toner container 34 are removed from the respective toner drain pipes 64Y, 64M, 64C, and 64BK and 65. When the residual toner container 34 gets full with the toner, it is replaced with a new empty residual toner container.

As the residual toner container 34 is placed close to the holder 33, the components to be maintained by the serviceman, etc., are concentrated in a single area and the maintenance job can be carried out easily.

As shown in FIG. 3, the door 31 of the main body 1 is provided at a position in front than the holder 33 at the closing position and along the direction in which the power-requiring unit is detached. However, the structure is such that when the door 31 is opened, a sensor (not shown) detects opening of the door 31 and based on the detection signals, the feed to the power-requiring units is prohibited. As a result, when the holder 33 is opened and the ends of the conductors part away from the electrodes, the defect caused due to the discharging can be prevented. When the holder 33 is closed again and then the door 31 is closed, electricity is provided to the power-requiring units from the power source 35 via each conductor.

Figure 6:
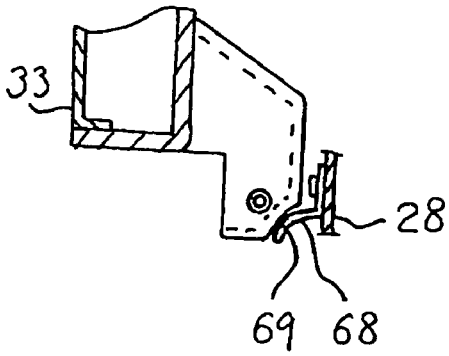
FIG. 6 illustrates a holding unit that maintains the holder at the opening position.

A holding unit may be arranged to hold the holder 33 opened. This arrangement will make the attaching and removing of the image bearing units or the intermediate transfer unit further easier. FIG. 6 illustrates an example of the holding unit. The holding unit includes a plate blade 68, the rear anchor part of which is fixed to the front board 28 of the main body 1, and a coupling surface 60 provided in the holder 33. When the holder 33 is opened, the plate blade 68 is pressure-welded to the coupling surface 69 of the holder 33 and thus the holder 33 is maintained at the opening position. Apart from this structure, a nail may be provided in the holder 33 and a coupling hole equivalent to the shape of the nail may be provided in the front board 28. Consequently, when the holder is opened, it can be held by coupling the nail and the coupling hole.

Figure 7:
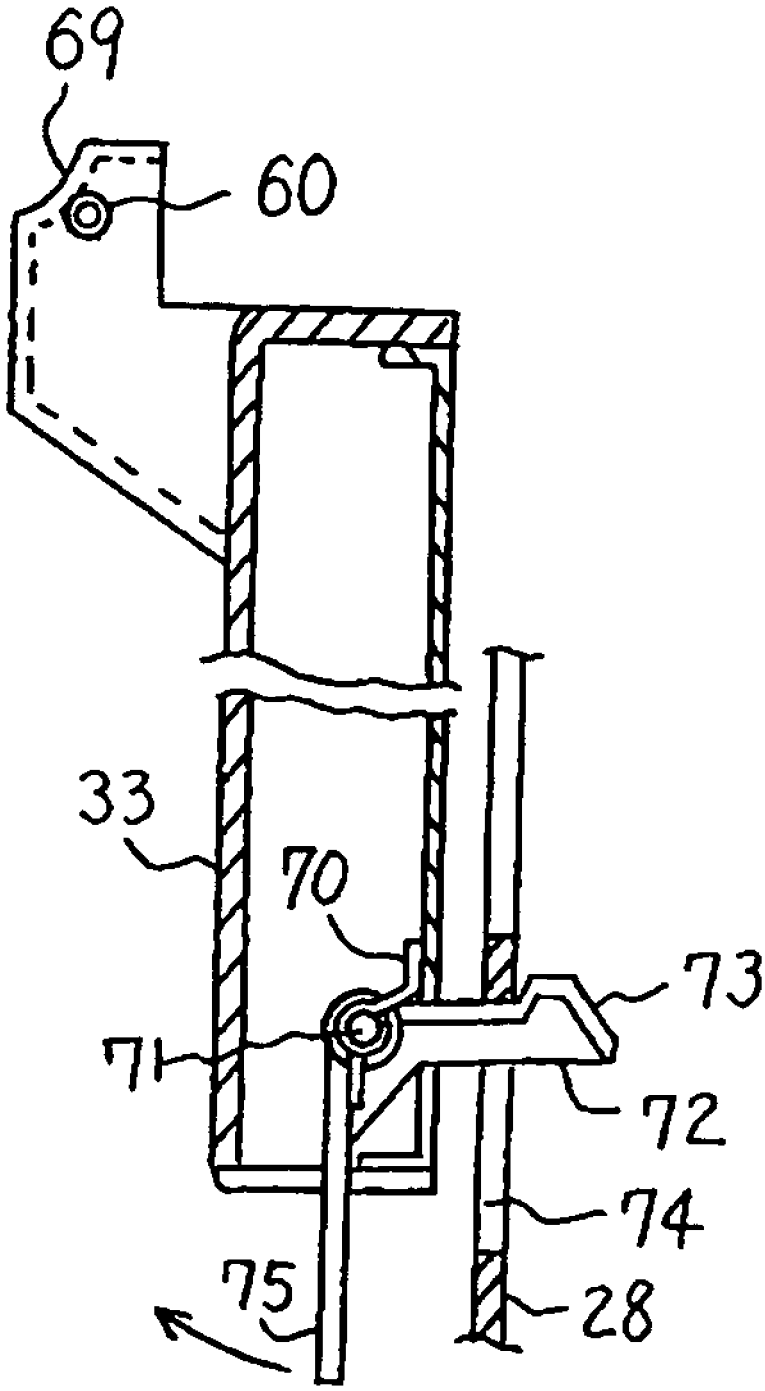
FIG. 7 is a cross-sectional view of a locking unit that locks the holder at the closing position.

A locking unit may be provided that locks the holder 33 when the holder 33 fixed. FIG. 7 illustrates an example of the locking unit. The locking unit includes a locking component 72 that is rotatably supported by the holder 33. Biasing of the locking component 72 in anticlockwise direction in FIG. 7 is carried out by means of a helical coil spring 70. When the holder 33 is closed, a nail 73 of the locking component 72 is coupled with the edge of a locking hole 74 provided in the front board 28 and the holder 33 is locked at the closing position. At the time of opening the holder 33, a handle 75 of the locking component 72 is grabbed and rotated in the direction of the arrow, and the nail 73 is removed from the edge of the locking hole 74. Instead of the locking unit as described above, a locking unit can be used that includes a screw, which fixes the holder 33 to the front board 28 such that the holder 33 can be attached to or removed from the front board 28. Another locking unit can be used that includes a protrusion provided in the holder 33 and a sleeve provided in the front board 28. When the holder is closed, the protrusion undergoes interdigitation with the sleeve and the frictional force generated in the protrusion and the sleeve locks the holder 33 at the closing position.

In FIG. 6 and FIG. 7, the first intermediate plate 42 and the second intermediate plate 43 of the holder 33 are not shown.

When the locking component 72 is provided, if the color of the locking component 72 is different than that of the front board 28 of the holder 33, the locking component 72 becomes distinctly visible. Thus, the user or the serviceman can easily locate the locking component 72 and the operations can be carried out comfortably. Hence, the color of a locking component is kept different than that of a holder.

As shown in FIG. 4, a mark M that shows the direction of rotation of the locking component 72 is either imprinted or a sticker that has the mark M on it is attached on the front side of the front plate 40 of the holder 33, so that the user operation becomes easier. Imprinting on the front plate 40 an explanation of the procedure of replacing the holder 33 or attaching a sticker with such an explanation can also improve the user-friendliness. The explanation could be a message such as 'Please open this particular part while replacing this particular component', etc.

Similarly, the other rollers such as the transfer rollers 12Y, 12M, and 12BK or the rollers 11Y to 11BK, etc., can also be electrically connected to the electrodes of the power-requiring units and the electrodes of the power source via the conductors supported by the holder.

According to the present invention, the electrodes of the power source as well as the electrodes of the power-requiring units are placed in the front along the direction in which the power-requiring units are detached. Moreover, the electrodes are electrically connected with corresponding ones using a holder. Thus, attachment or removal of the parts into or from the image forming apparatus can be performed easily.

The present document incorporates by reference the entire contents of Japanese priority document, 2002-316709 filed in Japan on Oct. 30, 2002.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus, comprising:

a main body having an opening;

a power-requiring unit that can be attached to the main body by being inserted in an insertion direction via the opening, and that can be detached from the main body by being pulled out in a detachment direction via the opening, the power-requiring unit having a front side toward the insertion direction and an electrode arranged on the front side;

a power source that supplies power to the power-requiring unit, the power source having a front side and an electrode arranged on the front side; and an arrangement that detachably fits almost into the opening and that includes an electric conductor, wherein the electric conductor makes electric contact with the electrodes of the power-requiring unit and the power source when the arrangement is fit, and the power-requiring unit can be attached or detached via the opening when arrangement is detached.

2. The image forming apparatus according claim 1, wherein the arrangement includes a plurality of insulation plates and the electric conductor is sandwiched between the insulation plates.

3. The image forming apparatus according to claim 1, wherein the electric conductor has a first end that makes an electric contact with the electrode of the power-requiring unit and a second end that makes an electric contact with the electrodes of the power source, wherein the first end and the second end are made of elastic material so that when the arrangement is fit, the first end and the second end are pressed against corresponding electrodes.

4. The image forming apparatus according to claim 1, further comprising an image bearing member on which a toner image is formed, wherein the image bearing member can be attached to or detached from the main body via the opening, wherein the arrangement includes an image-bearing-member positioning member to position the image bearing member in the main body.

5. The image forming apparatus according to claim 1, further comprising an image bearing unit that includes an image bearing member on which a toner image is formed and the power-requiring unit, wherein the image bearing unit can be attached to or detached from the main body via the opening, and wherein the arrangement includes an image-bearing-unit positioning member to adjust a position of the image bearing unit in the main body.

6. The image forming apparatus according to claim 5, wherein the electric conductor pushes a coupling member of the image bearing unit toward a coupling member of a driving device that drives the image bearing unit.

7. The image forming apparatus according to claim 1, further comprising an intermediate transfer unit that includes an image bearing member on which a toner image is formed and an intermediate transfer body on which the toner images are transferred, wherein the intermediate transfer unit can be attached to or detached from the main body via the opening, and wherein the arrangement includes an intermediate-transfer-unit positioning member to adjust a position of the intermediate transfer unit in the main body.

8. The image forming apparatus according to claim 7, wherein the electric conductor pushes a coupling member of the intermediate transfer unit toward a coupling member of a driving device that drives the intermediate transfer unit.

9. The image forming apparatus according to claim 1, wherein the power source can be attached to the main body by being inserted in an insertion direction via the opening, and that can be detached from the main body by being pulled out in a detachment direction via the opening, and the image forming apparatus further comprises a locking arrangement that prohibits detachment of the power source while the arrangement is fit to the main body.

10. The image forming apparatus according to claim 1, further comprising:

a container for storing used toner, wherein the container is located before, with respect to the insertion direction, the arrangement.

11. The image forming apparatus according to claim 1, wherein the main body includes a door, wherein the door is located before, with respect to the insertion direction, the arrangement.

12. The image forming apparatus according to claim 1, further comprising:

a holding unit that holds the arrangement, upon the arrangement is detached, so that the arrangement does not fit accidentally into the opening.

13. The image forming apparatus according to claim 1, further comprising:

a locking unit that locks the arrangement, upon the arrangement is fit.

14. The image forming apparatus according to claim 13, wherein the arrangement is painted with a first color and the locking unit is painted in a second color, which is different from the first color.

15. The image forming apparatus according to claim 1, wherein a plurality of the power-requiring units are provided.

16. The image forming apparatus according to claim 1, wherein the power-requiring unit is a charger that electrically charges an image bearing member.

17. The image forming apparatus according to claim 1, wherein the power-requiring unit is a driving unit of a roller.

* * * * *